US009133645B2

(12) United States Patent
Toglia et al.

(10) Patent No.: US 9,133,645 B2
(45) Date of Patent: Sep. 15, 2015

(54) ROD FITTINGS AND ASSEMBLIES

(71) Applicant: AGS Stainless, Inc., Bainbridge Island, WA (US)

(72) Inventors: Michael Toglia, Seattle, WA (US); Angelo Toglia, Bainbridge Island, WA (US); Gary Giffin, Kingston, WA (US); Dale Cavanaugh, Bremerton, WA (US); Jason Gregson, Bremerton, WA (US)

(73) Assignee: AGS Stainless, Inc., Bainbridge Island, WA (US)

( * ) Notice: Subject to any disclaimer, the term of this patent is extended or adjusted under 35 U.S.C. 154(b) by 146 days.

(21) Appl. No.: 14/046,808

(22) Filed: Oct. 4, 2013

(65) Prior Publication Data

US 2015/0097151 A1 Apr. 9, 2015

(51) Int. Cl.

| | |
|---|---|
| ***E04H 17/00*** | (2006.01) |
| ***E04H 17/20*** | (2006.01) |
| *E04H 17/14* | (2006.01) |

(52) U.S. Cl.

CPC ..... *E04H 17/20* (2013.01); *E04H 17/1421* (2013.01); *E04H 2017/1447* (2013.01); *E04H 2017/1465* (2013.01); *E04H 2017/1491* (2013.01)

(58) Field of Classification Search

CPC ..... Y10T 403/3986; Y10T 403/3993; Y10T 403/40; Y10T 403/405; Y10T 403/41; Y10T 403/46; Y10T 403/4617; Y10T 403/4681; F16B 21/086; E04F 11/181; A01K 97/10; A47H 1/14; A47H 1/142; A47F 5/0087; E04H 2017/1447; E04H 2017/1465; E04H 2017/1491; E04H 17/20; E04H 17/1421

USPC ..... 403/77, 200, 201, 230, 236, 258; 256/14–17, 65.01, 65.02, 65.12, 67, 256/68; 411/388, 339

See application file for complete search history.

(56) References Cited

U.S. PATENT DOCUMENTS

| | | | | |
|---|---|---|---|---|
| RE11,045 | E * | 12/1889 | Cleaveland | 256/67 |
| 1,663,203 | A * | 3/1928 | Luipersbek | 403/77 |
| 1,881,096 | A * | 10/1932 | Robbins | 285/261 |
| 4,142,809 | A * | 3/1979 | Shell | 403/201 |
| 4,278,276 | A * | 7/1981 | Ekman | 285/49 |
| 4,714,369 | A * | 12/1987 | Souza, Jr. | 403/190 |
| 5,558,375 | A * | 9/1996 | Newman | 285/23 |
| 6,971,831 | B2 * | 12/2005 | Fattori et al. | 411/508 |
| 6,994,326 | B1 * | 2/2006 | Tyson | 256/1 |
| 6,997,523 | B1 * | 2/2006 | Banoczky et al. | 303/87 |
| 7,134,647 | B2 * | 11/2006 | Graber | 256/65.02 |
| 7,665,927 | B2 * | 2/2010 | Bosley et al. | 403/135 |
| 7,927,035 | B2 * | 4/2011 | Molenaar | 403/77 |

OTHER PUBLICATIONS

Aecinfo.com Listing: "Stainless," downloaded on Aug. 22, 2013 from http://www.aecinfo.com/1/resourcefile/52/01/15/stainless_railing_brochure.pdf.

(Continued)

*Primary Examiner* — Gregory Binda
*Assistant Examiner* — Nahid Amiri

(57) ABSTRACT

Fittings can be configured to mechanically couple a rod to a post. In certain embodiments, rods and posts are joined to form railing systems. Fittings can include a first threaded end coupled to a second end. The second end can include a compliant member configured to provide an interference fit between the fitting and the rod.

20 Claims, 19 Drawing Sheets

(56) References Cited

OTHER PUBLICATIONS

Aluminum-rails.com Listing: "Lowe's Corporate HQ," downloaded on Aug. 22, 2013 from www.aluminum-rails.com/catalogs/lowes-corporate-hq-2009.pdf.
Aluminum-rails.com Listing: "Structural Glass Railing Designs," downloaded on Aug. 22, 2013 from www.aluminum-rails.com/catalogs/structural-glass-2010.pdf.
Amazonsupply.com Listing: "Anderson Metals Brass Push-On Hose Fitting, Connector, Barb x NPT male," downloaded on Sep. 3, 2013 from http://www.amazonsupply.com/anderson-metals-push-on-fitting-connector/dp/B0070TWB6A.
Amazonsupply.com Listing: "Brennan 6801-06-06-NWO-SS, Stainless Steel JIC Tube Fitting, 06MJ-06MAORB 90 Degree Elbow, 3/8" Tube OD x 9/16"-18 O-ring Boss, Male," downloaded on Sep. 3, 2013 from http://www.amazonsupply.com/brennan-6801-06-06-nwo-ss-stainless-fitting-06mj-06maorb/dp/B004Y18JO0.
Amazonsupply.com Listing: "Brennan 6802-06-06-NWO-SS, Stainless Steel, 37 Degree Flared Tube Fitting, 06MJ-06MAORB 45 Degrees Elbow, 3/8" Tube OD," downloaded on Sep. 3, 2013 from http://www.amazonsupply.com/brennan-6802-06-06-nwo-ss-stainless-fitting-06mj-06maorb/dp/B004Y18JUO.
Icrailing.com Listing: "Barrel," downloaded on Aug. 23, 2013 from http://icrailing.com/components/barrel/.
Icrailing.com Listing: "Custom Wood Post," downloaded on Aug. 23, 2013 from http://icrailing.com/components/custom-wood/.
Icrailing.com Listing: "Doric Post," downloaded on Aug. 23, 2013 from http://icrailing.com/components/doric/.
Icrailing.com Listing: "Imperial Post," downloaded on Aug. 23, 2013 from http://icrailing.com/components/imperial/.
Icrailing.com Listing: "Millenium," downloaded on Aug. 23, 2013 from http://icrailing.com/components/millenium/.
Icrailing.com Listing: "Rods," downloaded on Aug. 23, 2013 from http://icrailing.com/components/rods/.
Icrailing.com Listing: "Swivel," downloaded on Aug. 23, 2013 from http://icrailing.com/components/swivel/.
Inlinedesign.us Listing: "Bar Parts," downloaded on Aug. 23, 2013 from http://inlinedesign.us/t/bar-parts.
Inlinedesign.us Listing: "Stainless Steel Bar Holder Square," downloaded on Aug. 23, 2013 from http://inlinedesign.us/products/stainless-steel-bar-holder-square.
Inlinedesign.us Listing: "Stainless Steel Square Bar 1/2" and 8.20 feet Long," downloaded on Aug. 23, 2013 from http://inlinedesign.us/products/stainless-steel-square-bar-half-inch-and-8-dot-20-feet-long.
Inlinedesign.us Listing: "Stainless Steel Square Bar Connector Pivot," downloaded on Aug. 23, 2013 from http://inlinedesign.us/products/stainless-steel-square-bar-connector-pivot.
Stainless-railing.com Listing: "Stainless Handrails & Railings," downloaded on Aug. 23, 2013 from http://www.stainless-railing.com/.

* cited by examiner

ROD FITTINGS AND ASSEMBLIES

BACKGROUND

1. Field

Various embodiments disclosed herein relate to fittings. Certain embodiments relate to fittings configured to mechanically couple rods to posts.

2. Description of Related Art

Railing systems can prevent people from falling from decks, stairs, and balconies. Railing systems can include horizontal members coupled to vertical members. For example, multiple horizontal bars can be coupled to posts to form a railing system that can block people and objects from falling from decks, stairs, and balconies. In some cases, horizontal bars are welded to vertical posts, yet this construction method can be time consuming and expensive. In addition, welded joints can leave joining scars that are cosmetically unpleasing and unpredictable. Welding can also compromise the corrosion resistance of some metals.

Thus, there is a need for fittings that enable faster and/or less expensive construction of railing systems. There is also a need for joining systems and methods that enable more cosmetically pleasing and/or predictable results. Various embodiments described herein address at least some of these needs.

SUMMARY

In some embodiments, a fitting is configured to mechanically couple a rod to a post. The fitting can include a first threaded end and a second unthreaded end coupled to the first threaded end. The second unthreaded end of the fitting can include a first groove and a first o-ring. At least a portion of the first o-ring can be located in the first groove. The fitting can be configured to enable the rod to slide over the first o-ring. The second unthreaded end of the fitting can include a second groove and a second o-ring. At least a portion of the second o-ring can be located in the second groove. The fitting can be configured to enable the rod to slide over the second o-ring. Some embodiments include other types of seals and/or additional o-rings.

In several embodiments, a fitting can include a movable joint that couples the first threaded end to the second unthreaded end. The movable joint can be configured to enable the first threaded end to move relative to the second unthreaded end. The movable joint can include a ball end rotatably coupled to a socket end to form a multiaxial joint.

In some embodiments, the first o-ring can include an outer diameter and the fitting can include a central axis. The fitting can be configured to enable the rod to slide over the first o-ring to compress the outer diameter of the first o-ring towards the central axis of the fitting. The fitting can be configured to enable similar compression of additional seals and/or o-rings. The first o-ring and the second o-ring can be radial seals.

In several embodiments, the first groove includes a first diameter and the second groove comprises a second diameter. The first diameter and the second diameter can be isodiametric. The fitting can include a cylindrical portion that attaches the first groove to the second groove. The cylindrical portion can be unthreaded and/or isodiametric. The cylindrical portion can directly attach the first groove to the second groove such that the first groove is located on one end of the cylindrical portion and the second groove is located on the other end of the cylindrical portion.

In some embodiments, the second unthreaded end includes a first cylindrical portion having a first outer diameter, a second cylindrical portion having a second outer diameter, and a third cylindrical portion having a third outer diameter. The first cylindrical portion can be located distally relative to the first groove and the second groove. The second cylindrical portion can be located between the first groove and the second groove. The third cylindrical portion can be located proximally relative to the first groove and the second groove. The first cylindrical portion, the second cylindrical portion, and/or the third cylindrical portion can be isodiametric.

In several embodiments, a fitting includes a central axis, a first flat surface oriented parallel to the central axis, and a second flat surface oriented parallel to the central axis. The first flat surface and the second flat surface can be located on opposite sides of the central axis of the fitting. In several embodiments, the second unthreaded end includes a central axis, a first flat surface oriented parallel to the central axis, and a second flat surface oriented parallel to the central axis. The first flat surface and the second flat surface can be located on opposite sides of the central axis of the second unthreaded end.

In some embodiments, the fitting can include a shoulder that couples the first threaded end to the second unthreaded end. The shoulder can extend farther radially outward than any other portion of the fitting.

In several embodiments, a fitting system is configured to mechanically couple a rod to a post. The fitting system can include a fitting comprising a first threaded end and a second unthreaded end coupled to the first threaded end. The second unthreaded end can include a first groove and a first compliant member. The first compliant member can be a first seal, a first hoop seal, a first o-ring, a first wiper seal, and/or a first rubber member.

In some embodiments, the first compliant member (e.g., the first seal) does not need to form an actual seal, but instead is configured to deform as the rod slides over a portion of the second unthreaded portion to ensure a tight fit (e.g., an interference fit) between the rod and the fitting. At least a portion of the compliant member (e.g., the first seal) can be located in the first groove.

In several embodiments, the rod includes a hollow inner channel. The second unthreaded end of the fitting can be configured to slide into the hollow inner channel of the rod. The post can include a threaded hole. The first threaded end of the fitting can be configured to threadably couple with the threaded hole of the post.

In some embodiments, the rod can be coupled to the second unthreaded end of the fitting such that the first seal is compressed radially inward by the rod and the first seal is located distally relative to the proximal end of the rod. The first threaded end can be threadably coupled to the threaded hole of the post (e.g., by screwing the first threaded end into the threaded hole).

Several embodiments include methods for using a fitting to couple a rod to a post. The fittings, rods, and/or posts can be made from metal and configured to form at least a portion of a railing system. Embodiments can include obtaining a fitting comprising a first threaded end and a second end coupled to the first threaded end, wherein the second end comprises a first groove and a first seal, wherein at least a portion of the first seal is located in the first groove. Embodiments can include obtaining a rod comprising a hollow inner channel, wherein the second end of the fitting is configured to slide into the hollow inner channel of the rod. Some embodiments include obtaining a post comprising at least one threaded hole. Some posts include at least three holes, at least five holes, or at least ten holes, wherein each hole can be configured to attach to a rod via a fitting. Thus, one post can couple to one rod, at least three rods, at least five rods, at least ten rods, or any suitable number of rods via at least one fitting per rod.

Some embodiments include screwing the first threaded end of the fitting into the threaded hole of the post and/or sliding the rod over the second end of the fitting such that the first seal is located inside of the hollow inner channel of the rod. In several embodiments, the rod comprises an inner diameter and the first seal comprises an outer diameter that is larger than the inner diameter of the rod. Some embodiments include compressing the outer diameter of the first seal radially inward by sliding the rod over the first seal. Thus, the first seal can be radially compressed by the rod.

In several embodiments, the fitting comprises a ball end rotatably coupled to a socket end to form a multiaxial joint. Some embodiments include changing the orientation of the rod relative to the post by moving the ball end within the socket end. Several methods include orienting the first threaded end of the fitting perpendicularly relative to the post and/or orienting the second end of the fitting at an angle of stairway rise.

Several methods include orienting at least one post vertically and orienting at least one rod horizontally. In some cases, rods are oriented at an angle relative to a horizontal plane (e.g., to accommodate stairs or angled surfaces).

BRIEF DESCRIPTION OF THE DRAWINGS

These and other features, aspects, and advantages are described below with reference to the drawings, which are intended to illustrate but not to limit the invention. In the drawings, like reference characters denote corresponding features consistently throughout similar embodiments.

DETAILED DESCRIPTION

Figure 1:
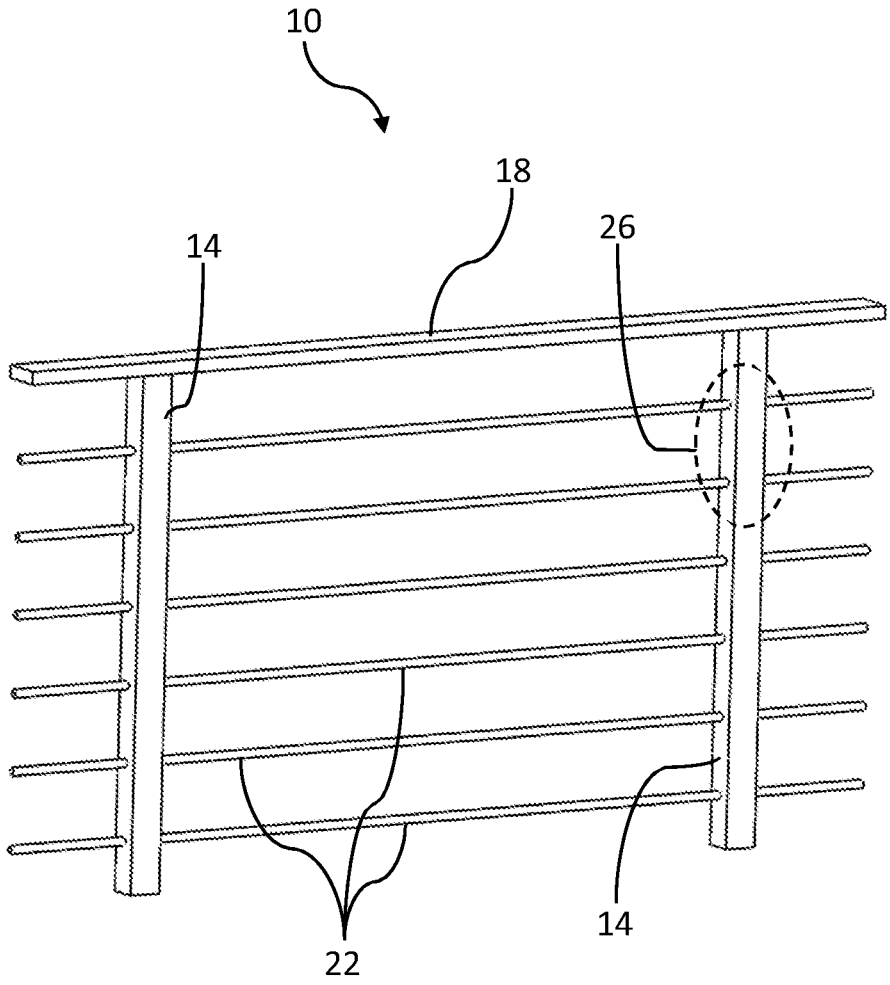
FIG. 1 illustrates a perspective view of a portion of a railing system, according to some embodiments.

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described herein. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein. No feature, benefit, advantage, structure, or step disclosed herein is essential or indispensable.

The drawings illustrate certain embodiments and are not intended to be limiting. The drawings can be semi-diagrammatic and not to scale. For clarity of presentation and discussion, some portions of and/or dimensions in the drawings are shown greatly exaggerated.

FIG. 1 illustrates a perspective view of a portion of a railing system embodiment 10 configured to prevent people, animals, and objects from falling from decks, stairs, and balconies. The railing system 10 can include vertical posts 14 and horizontal rails 18. The rails 18 can be coupled to the tops of posts 14. Some rails 18, such as stairway rails, are not horizontal.

Railing systems can include rods 22 to prevent people, animals, and objects from passing between the posts 14. In several embodiments, the rods 22 are coupled to posts 14. Not all of the rods 22 are labeled in FIG. 1 in the interest of clarity.

As used herein, the term "rod" includes bars of various materials including metal, plastic, and wood. Rods are often much longer than they are wide. In several embodiments, rods can be hollow, partially hollow, or solid. In some embodiments, rods have a hollow end and/or a cavity at one end that is configured to receive a fitting. In several embodiments, fittings slide into a portion of a rod. Rods can be extruded with diverse cross-sectional shapes, including circular cross sections, oval cross sections, rectangular cross sections, square cross sections, and star-shaped cross sections.

In some embodiments, rails 18, posts 14, and rods 22 are made from metal, plastic, and/or wood. Some embodiments include plastic rails 18, posts 14, and/or rods 22 colored and/or textured to look like metal or wood.

Figure 2:
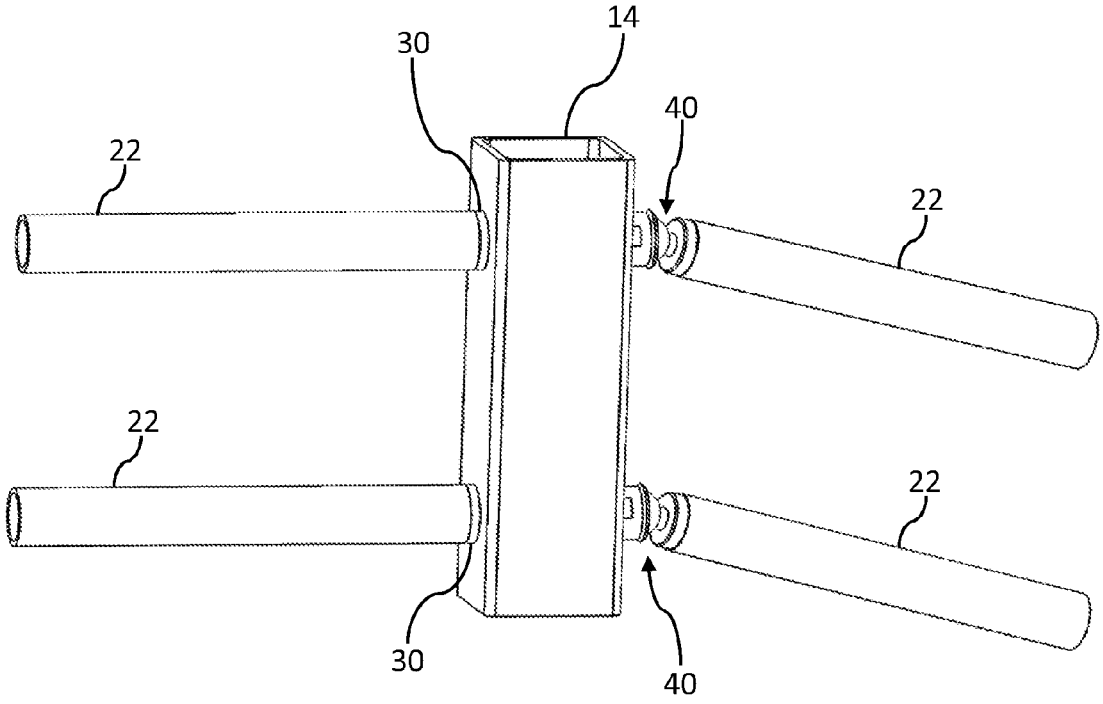
FIG. 2 illustrates a perspective view of rods mechanically coupled to a post via fittings, according to some embodiments.

The dashed circle in FIG. 1 indicates a location 26 where rods 22 are coupled to a post 14 by fittings (not shown). FIG. 2 illustrates a perspective view of an embodiment of rods 22 mechanically coupled to a post 14 via fittings 30, 40. The rods 22 and post 14 in FIG. 2 are much shorter than rods and posts used in many embodiments. The rods 22 and post 14 can be hollow and extruded metal.

As used herein, a "fitting" is an apparatus that is configured to couple one member to another member. A fitting can be a mechanical coupling device. In some embodiments, a fitting can be a mechanical device used to couple a post to a rod.

Figure 3:
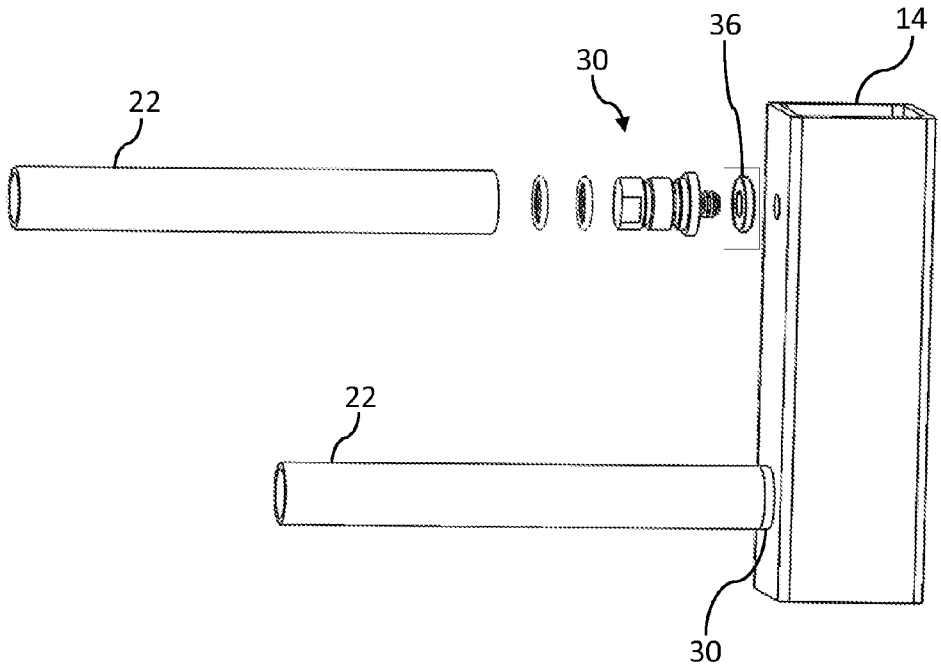
FIG. 3 illustrates an exploded perspective view of a post with a fitting, according to some embodiments.

FIG. 3 illustrates an exploded perspective view of a post 14 with a first fitting 30 and a second fitting 30. The second fitting 30 in FIG. 3 is shown in an exploded configuration. In some embodiments, the fittings 30 are configured to couple a rod 22 at a 90 degree angle relative to the post 14.

Figure 4:
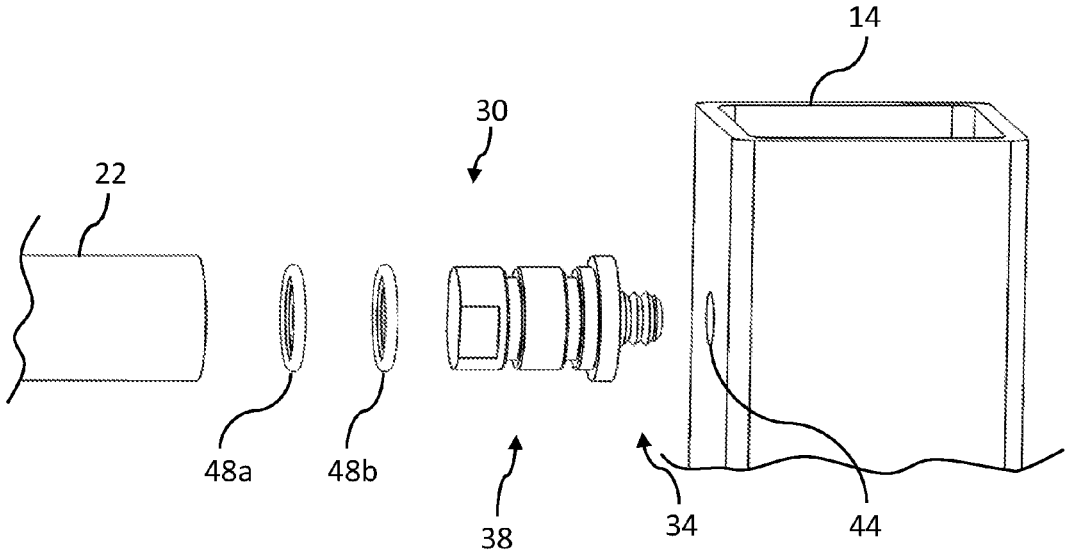
FIG. 4 illustrates an exploded perspective view of the fitting from FIG. 3, according to some embodiments.

FIG. 4 illustrates an exploded view of the fitting 30 from FIG. 3. The fitting 30 can include a first threaded end 34 and a second unthreaded end 38 coupled to the first threaded end 34. The second unthreaded end 38 of the fitting 30 can include a first groove 52*a* (labeled in FIG. 10) and a first seal 48*a*, which can be an o-ring or any other type of compliant member or seal. At least a portion of the first o-ring 48*a* can be located in the first groove 52*a*. The fitting 30 can be configured to enable the rod 22 to slide over the first seal 48*a* and/or over a second seal 48*b*, which can be an o-ring or any other type of compliant member or seal. The second unthreaded end 38 of the fitting 30 can include a second groove 52*b* (labeled in FIG. 10) and the second seal 48*b*. At least a portion of the second seal 48*b* can be located in the second groove 52*b*. Some embodiments include other types of seals and/or additional o-rings.

Figure 5:
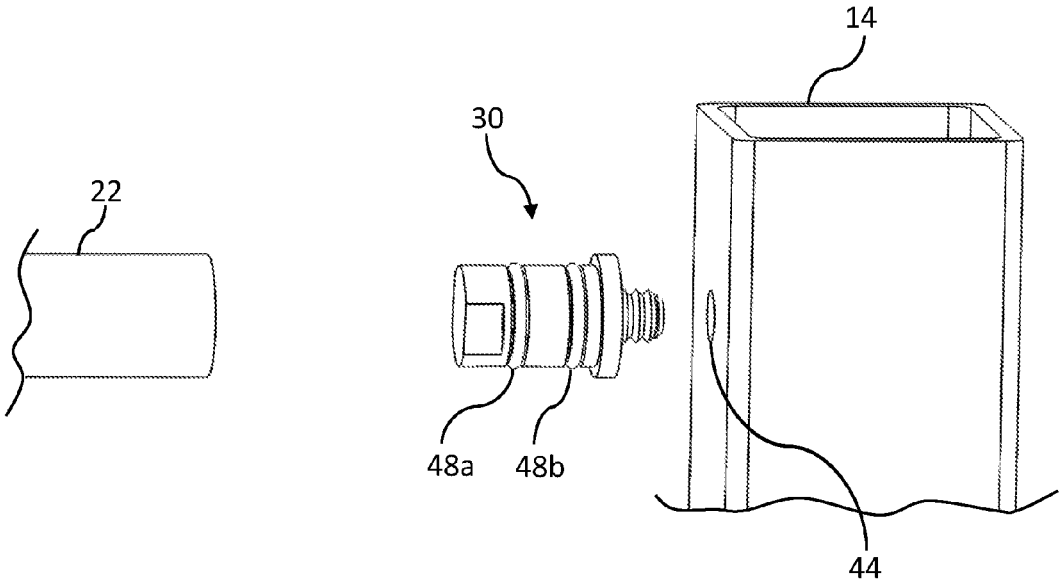
FIG. 5 illustrates a perspective view of seals placed within grooves of a fitting before the fitting is threaded into a threaded hole of the post, according to some embodiments.

FIG. 5 illustrates a perspective view of seals 48*a*, 48*b* placed within grooves of the unthreaded end 38 (shown in FIG. 4) before the fitting 30 is threaded into a threaded hole 44 of the post 14. The first threaded end 34 (labeled in FIG. 4) of the fitting 30 can be configured to threadably couple with the threaded hole 44 of the post 14.

Figure 6:
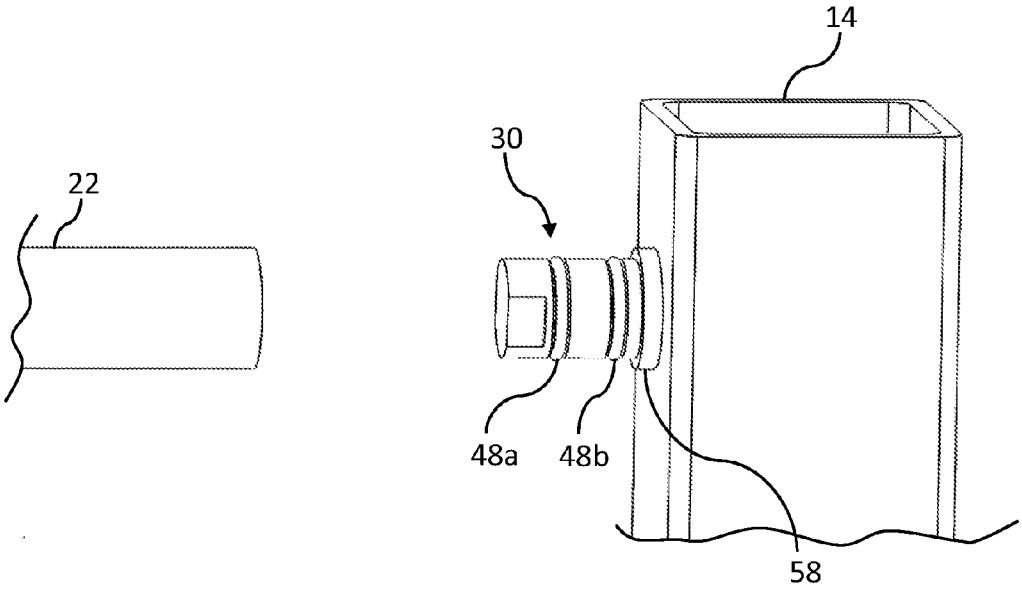
FIG. 6 illustrates a perspective view of the fitting after it is threaded into the threaded hole shown in FIG. 5, according to some embodiments.
Figure 7:
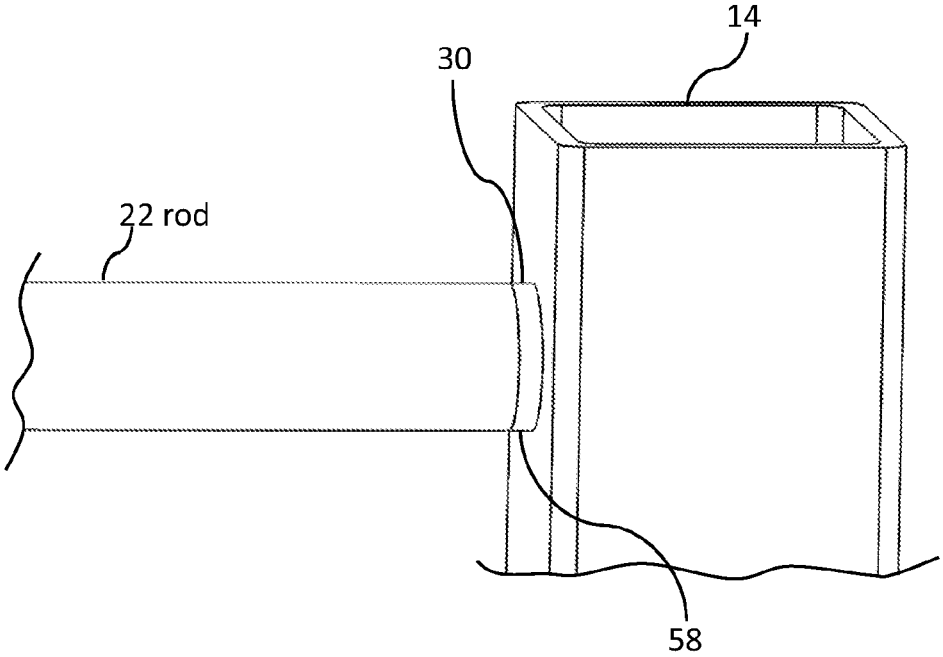
FIG. 7 illustrates a perspective view after the rod is slid over a portion of the fitting, according to some embodiments.

FIG. 6 illustrates a perspective view of the fitting 30 after it is threaded into the threaded hole 44 shown in FIG. 5. The fitting 30 can include a shoulder 58 configured to limit how deeply the fitting 30 can thread into the threaded hole 44 of the post 14 and/or configured to limit how far the fitting 30 can slide into a hollow portion of the rod 22. FIG. 7 illustrates a perspective view after the rod 22 is slid over a portion of the fitting 30 (e.g., up to the shoulder 58).

Figure 8:
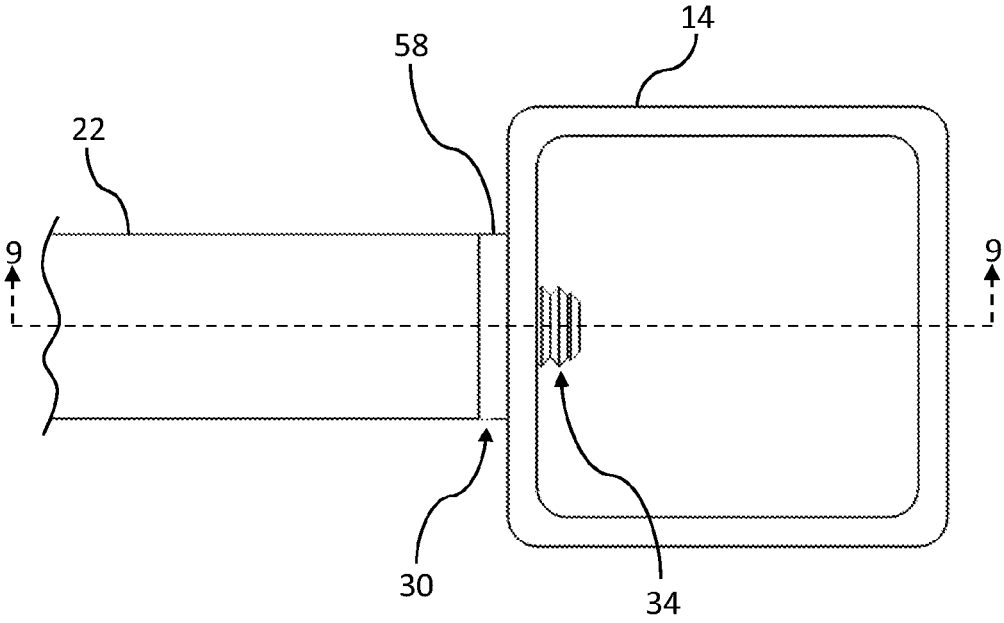
FIG. 8 illustrates a top view of the rod mechanically coupled to the post via a fitting, according to some embodiments.
Figure 9:
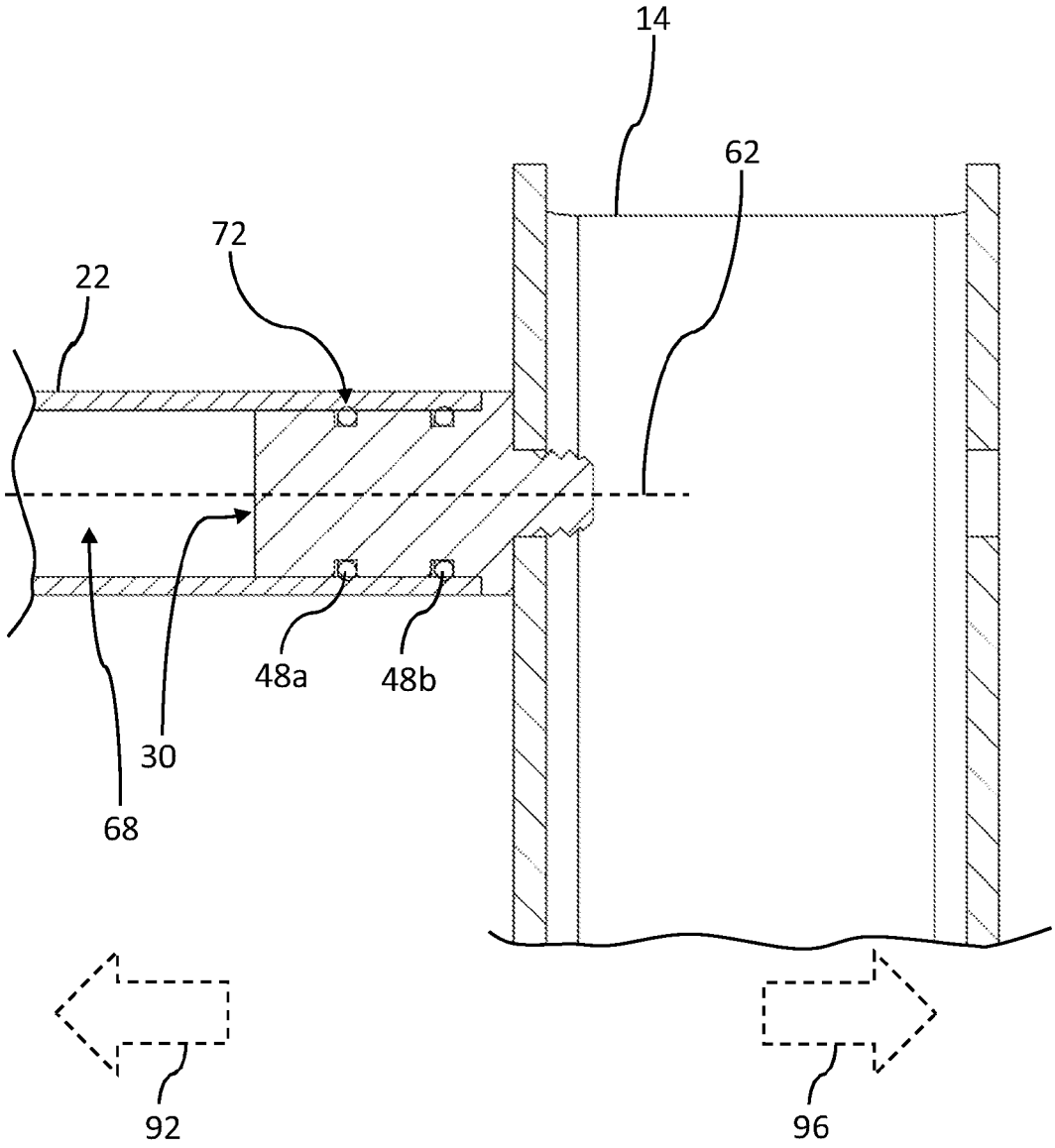
FIG. 9 illustrates a cross-sectional view along line 9-9 from FIG. 8, according to some embodiments.

FIG. 8 illustrates a top view of the rod 22 mechanically coupled to the post 14 via a fitting 30. FIG. 9 illustrates a cross-sectional view along line 9-9 from FIG. 8. In some embodiments, the first seal 48*a* (e.g., an o-ring) can include an outer diameter and the fitting 30 can include a central axis 62. The fitting 30 can be configured to enable the rod 22 to slide over the first o-ring to compress the outer diameter 72 of the first seal 48*a* towards the central axis 62 of the fitting 30. The fitting 30 can be configured to enable similar compression of additional seals and/or o-rings (e.g., the seal 48*b*). The first seal 48*a* (e.g., the first o-ring) and the second seal 48*b* (e.g., the second o-ring) can be radial seals. An embodiment with radial seals (i.e., the seals 48*a*, 48*b*) is illustrated in FIG. 9. The rod 22 can have a hollow portion (e.g., a hollow inner channel 68) and the fitting 30 can be configured to at least partially fit within a section of the hollow portion. The second unthreaded end of the fitting 30 can be configured to slide into the hollow inner channel 68 of the rod 22.

In some embodiments, the rod 22 can be coupled to the second unthreaded end of the fitting 30 such that the first seal 48*a* is compressed radially inward by the rod 22 and the first seal 48*a* is located distally relative to the proximal end of the rod 22. The first threaded end can be threadably coupled to the threaded hole of the post (e.g., by screwing the first threaded end into the threaded hole).

Figure 10:
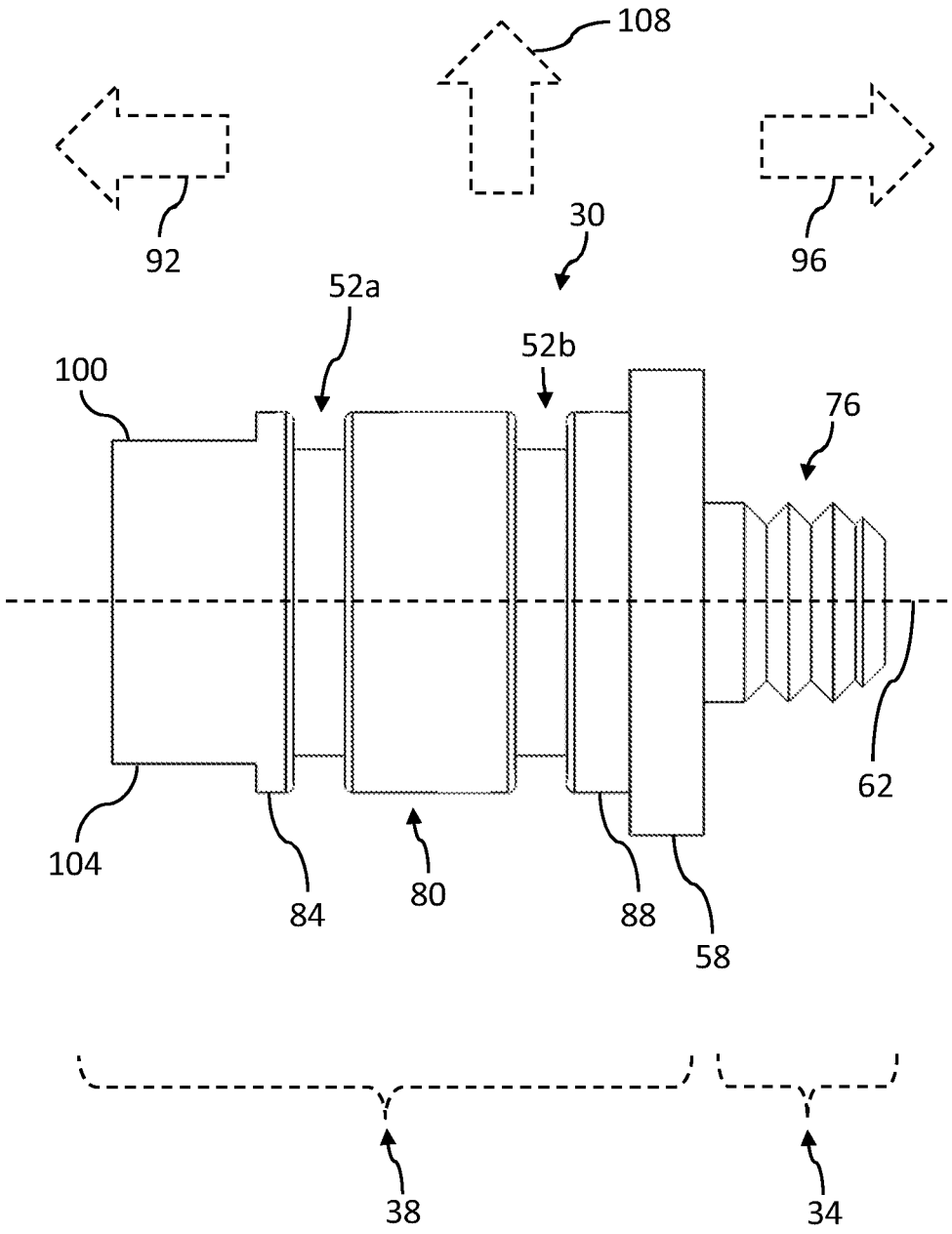
FIG. 10 illustrates a side view of a fitting, according to some embodiments.

FIG. 10 illustrates a side view of a fitting 30. The fitting 30 can have a threaded end 34 with threads 76. The unthreaded end 38 can include a first groove 52*a* and a second groove 52*b*. In several embodiments, the first groove 52*a* includes a first diameter and the second groove 52*b* comprises a second diameter. The first diameter and the second diameter can be isodiametric (as illustrated in FIG. 10). The fitting 30 can include a cylindrical portion 80 that attaches the first groove to the second groove. The cylindrical portion 80 can be unthreaded and/or isodiametric. The cylindrical portion 80 can directly attach the first groove 52*a* to the second groove 52*b* such that the first groove 52*a* is located on one end of the cylindrical portion 80 and the second groove 52*b* is located on the other end of the cylindrical portion 80.

In some embodiments, the second unthreaded end 38 includes a first cylindrical portion 84 having a first outer diameter, a second cylindrical portion (e.g., cylindrical portion 80) having a second outer diameter, and a third cylindrical portion 88 having a third outer diameter. FIG. 10 includes a distal direction 92 and a proximal direction 96 relative to the central axis 62 of the fitting 30. The first cylindrical portion 84 can be located distally relative to the first groove 52*a* and the second groove 52*b*. The second cylindrical portion 80 can be located between the first groove 52*a* and the second groove 52*b*. The third cylindrical portion 88 can be located proximally relative to the first groove 52*a* and the second groove 52*b*. The first cylindrical portion 84, the second cylindrical portion 80, and/or the third cylindrical portion 88 can be isodiametric. In some embodiments, the first cylindrical portion 84, the second cylindrical portion 80, and/or the third cylindrical portion 88 have the same diameter.

In several embodiments, a fitting 30 includes a central axis 62, a first flat surface 100 oriented parallel to the central axis 62, and a second flat surface 104 oriented parallel to the central axis 62. The first flat surface 100 and the second flat 104 surface can be located on opposite sides of the central axis 62 of the fitting 30 (as shown in FIG. 10). In several embodiments, the second unthreaded end 38 includes a central axis 62, a first flat surface 100 oriented parallel to the central axis 62, and a second flat surface 104 oriented parallel to the central axis 62.

In some embodiments, the fitting 30 can include a shoulder 58 that couples the first threaded end 34 to the second unthreaded end 38. The shoulder 58 can extend farther radially outward than any other portion of the fitting 30. The arrow 108 in FIG. 10 indicates a radially outward direction relative to the central axis 62 of the unthreaded end 38.

Figure 11:
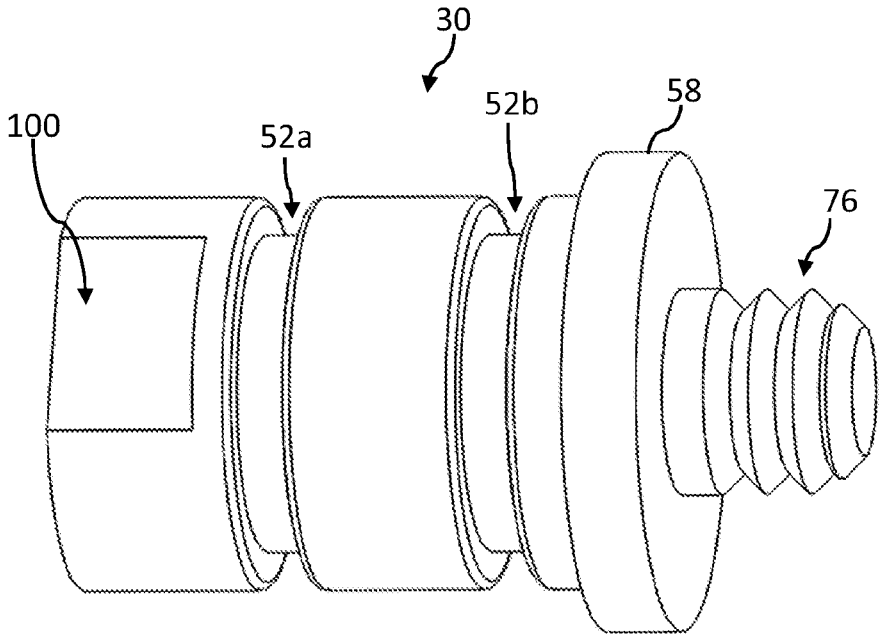
FIGS. 11 and 12 illustrate perspective views of a fitting, according to some embodiments.
Figure 12:
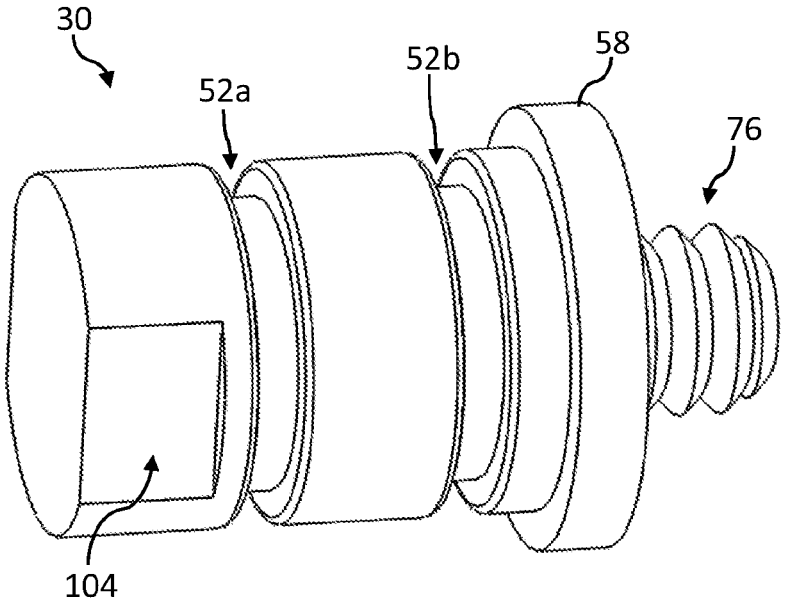

FIGS. 11 and 12 illustrate perspective views of the fitting 30. Not all items are labeled in the Figures in the interest of increasing the clarity of particular items in the Figures.

In several embodiments, a fitting system is configured to mechanically couple a rod to a post. The fitting system can include a fitting comprising a first threaded end and a second unthreaded end coupled to the first threaded end. The second unthreaded end can include a first groove and a first compliant member. The first compliant member can be a first seal, a first hoop seal, a first o-ring, a first wiper seal, and/or a first rubber member.

Figure 13:
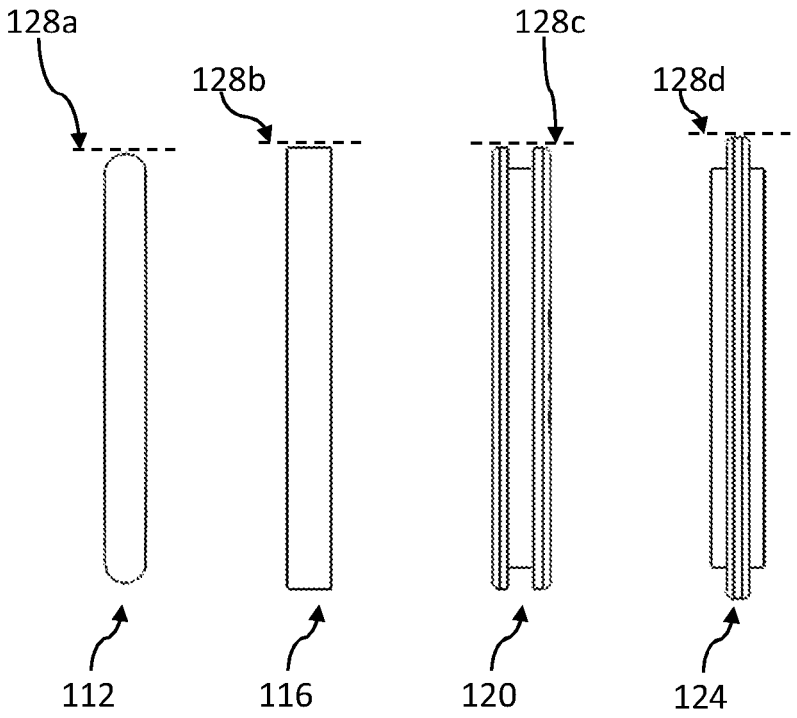
FIG. 13 illustrates a side view of various compliant members that can be seals, according to some embodiments.
Figure 14:
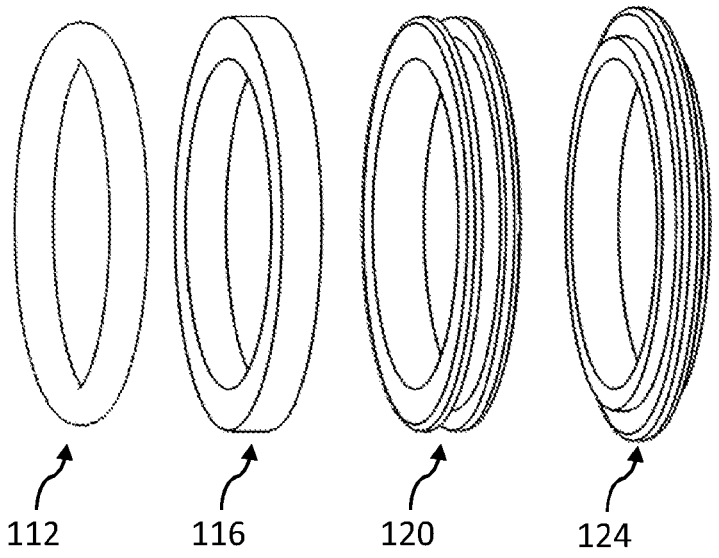
FIG. 14 illustrates a perspective view of the compliant members from FIG. 13, according to some embodiments.

FIG. 13 illustrates side views of various compliant members that can be seals. The compliant members in FIG. 13 are hoop seals because they form a hoop shape. The compliant members in FIG. 13 can be radial seals if they are placed in a suitable fitting that enables radial compression when a portion of a rod is placed over the fitting. In some embodiments, the compliant members in FIG. 13 are made from rubber, and thus, can be rubber members. FIG. 13 includes o-rings 112, 116 and wiper seals 120, 124. Each of the compliant members illustrated in FIG. 13 include outer diameters 128*a*, 128*b*, 128*c*, 128*d* that can be compressed radially inward when a portion of a rod is slid over a portion of a fitting. FIG. 14 illustrates a perspective view of the compliant members from FIG. 13. Compliant members can have many different shapes, including shapes other than the illustrated embodiments. Not all compliant member embodiments form hoops.

In some embodiments, the first compliant member (e.g., the first seal) does not need to form an actual seal (e.g., a watertight seal), but instead is configured to deform as the rod slides over a portion of the second unthreaded portion to create a tight fit (e.g., an interference fit) between the rod and the fitting. At least a portion of the compliant member (e.g., the first seal) can be located in the first groove. Any of the compliant members illustrated in FIGS. 13 and 14 can be placed in the grooves (e.g., 52*a*, 52*b* in FIG. 10) of fittings (e.g., 30 in FIG. 10).

Compliant members, such as various seals, can be made from rubber and/or plastic. In some embodiments, compliant members are molded from elastomeric compounds of monomer units forming polymers that are vulcanized. Compliant members can be made from different types of rubber including silicone, nitrile, and neoprene available from Apple Rubber Products, Inc.

In some embodiments, seals are used for their ability to deform to create an interference fit between a rod and a fitting, rather than due to an ability to create a fluid seal. Interference fits can prevent (or at least reduce) "rattling" or movement between a fitting and a rod. In several embodiments, seals are used to create fluid seals to prevent fluid ingress (e.g., of water).

In several embodiments, a fitting can include a movable joint that couples a first threaded end to a second unthreaded end. The movable joint can be configured to enable the first threaded end to move relative to the second unthreaded end.

Figure 15:
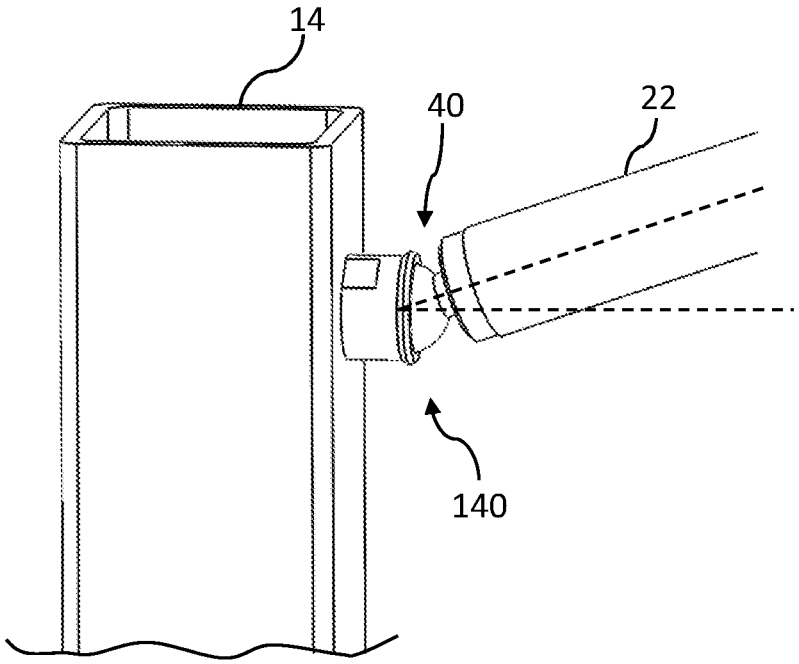
FIGS. 15 and 16 illustrate perspective views of a fitting with a movable joint oriented at two different angles relative to the post, according to some embodiments.
Figure 16:
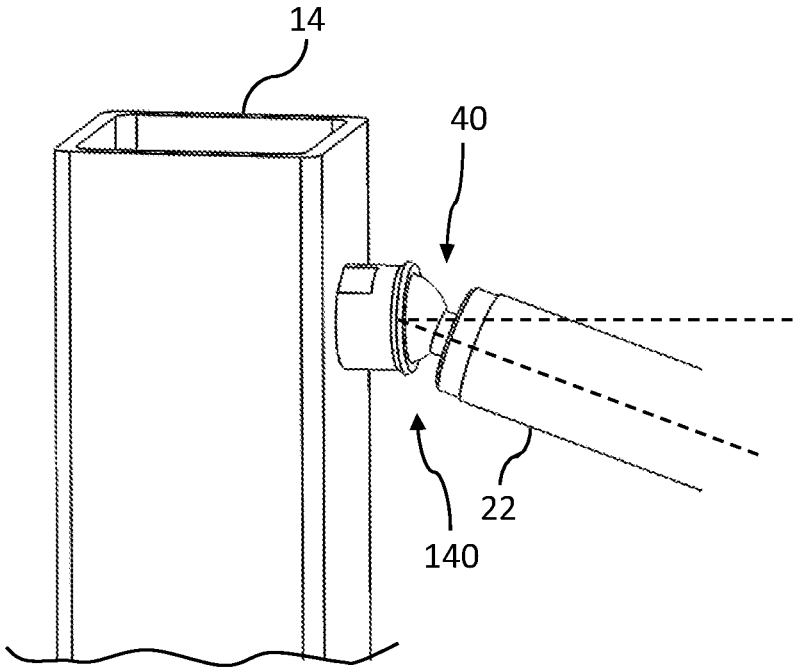

FIGS. 15 and 16 illustrate perspective views of a fitting 40 with a movable joint 140 oriented at two different angles relative to the post 14. In some embodiments, the movable joint 140 enables the rod and/or the second unthreaded end to move at least 20 degrees, at least 45 degrees, at least 90 degrees, or at least 180 degrees relative to the post 14.

Figure 17:
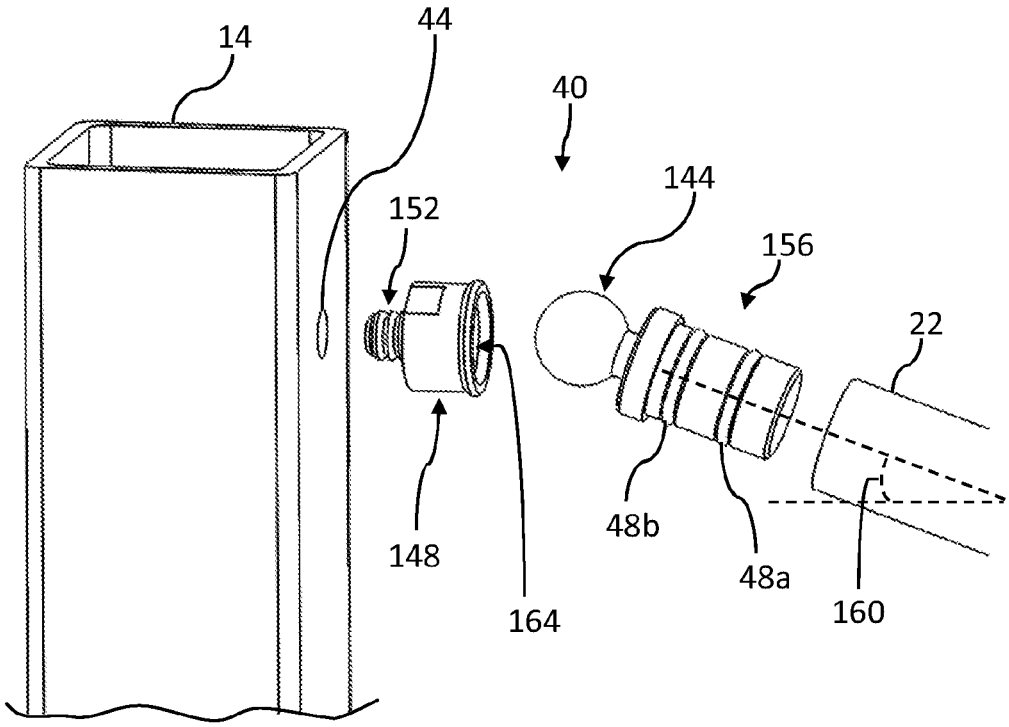
FIG. 17 illustrates an exploded perspective view of a fitting with a movable joint, according to some embodiments.

FIG. 17 illustrates an exploded perspective view of a fitting 40 with a movable joint 140. The movable joint 140 can include a ball end 144 rotatably coupled to a socket end 148 to form a multiaxial joint. Some embodiments include changing the orientation of the rod 22 relative to the post 14 by moving the ball end 144 within the socket end 148. Several methods include orienting the first threaded end 152 of the fitting 40 perpendicularly relative to the post 14 and/or orienting the second end 156 of the fitting 40 at an angle of stairway rise 160. The first end 152 can include threads 180 (shown in FIG. 18).

Figure 18:
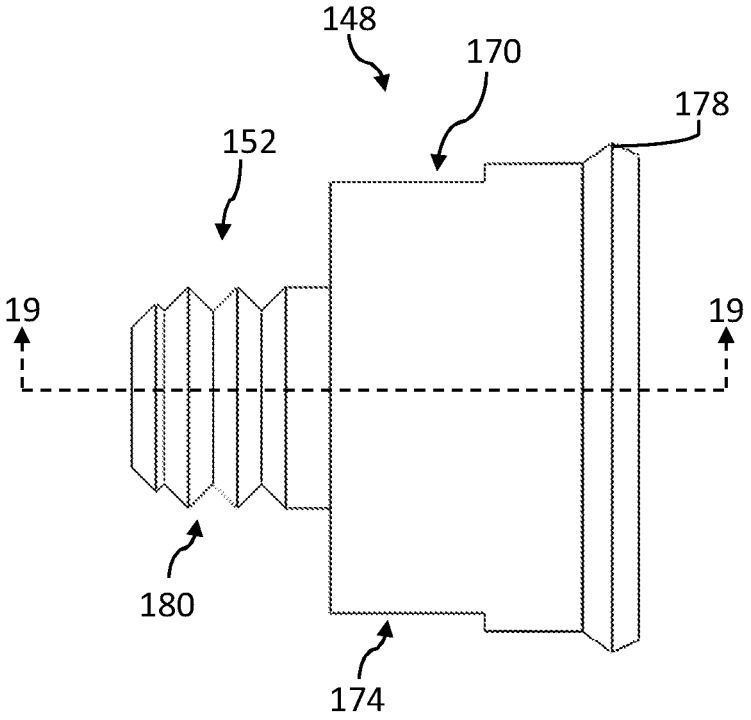
FIG. 18 illustrates a side view of a socket end, according to some embodiments.
Figure 19:
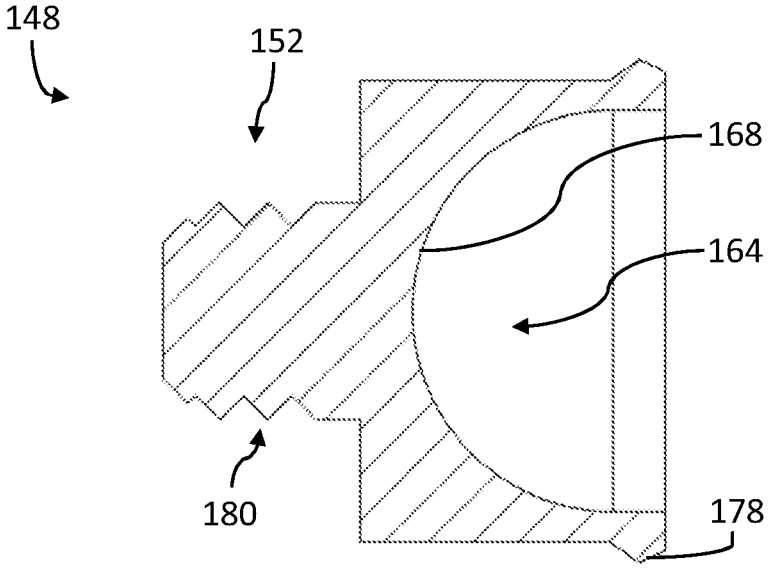
FIG. 19 illustrates a cross-sectional view along line 19-19 from FIG. 18, according to some embodiments.

FIG. 18 illustrates a side view of the socket end 148. FIG. 19 illustrates a cross-sectional view along line 19-19 from FIG. 18. Referring now to FIGS. 18 and 19, the socket end 148 can include a first threaded end 152 and an unthreaded portion. The unthreaded portion can include a first flat surface 170 and a second flat surface 174 configured to enable a user to grasp the socket end 148 with a tool, such as a wrench, to thread the socket end 148 into a threaded hole of a post or rail. The socket end 148 can include a crimp 178 to secure (e.g., couple) the socket end 148 to the ball end 144 and/or to the second end 156 (shown in FIG. 17). The socket 164 can include a spherical portion 168.

Figure 20:
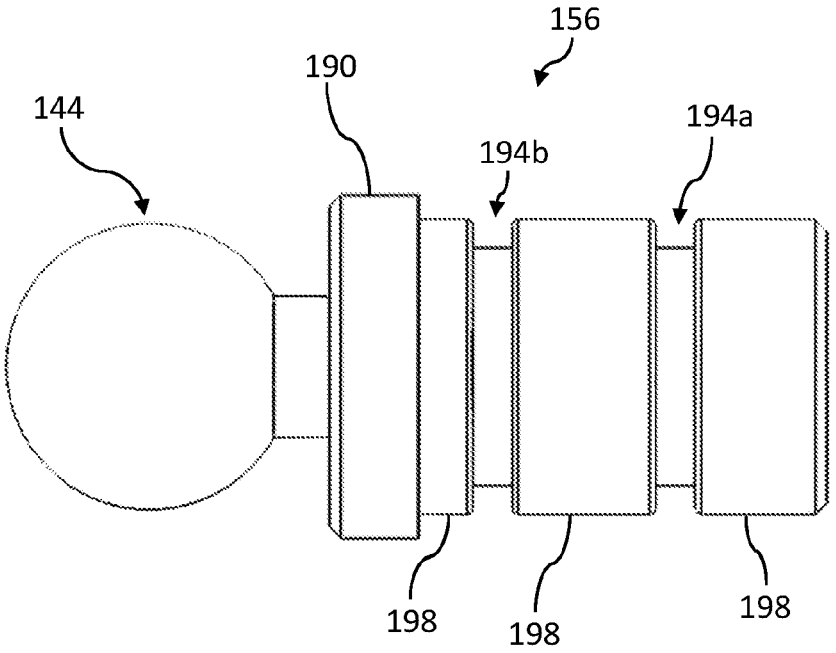
FIG. 20 illustrates a side view of a second end, which is configured to couple with a socket end to form a fitting, according to some embodiments.
Figure 21:
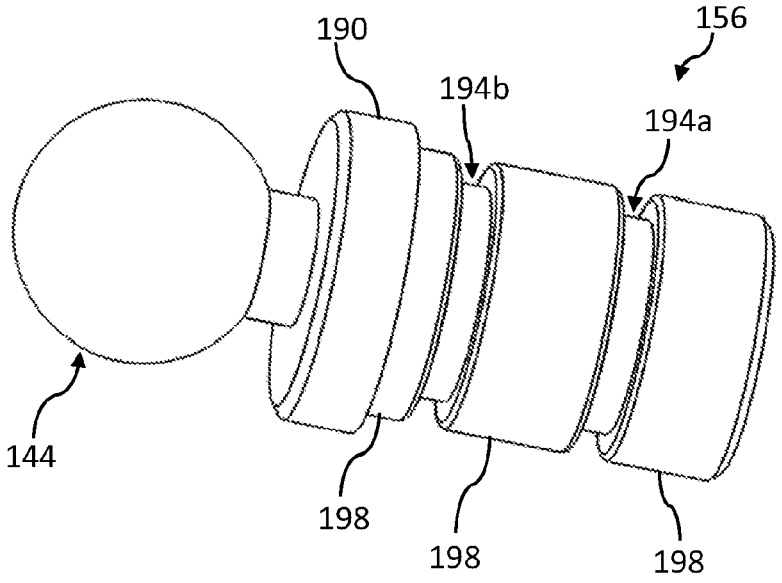
FIG. 21 illustrates a perspective view of a second end, according to some embodiments.
Figure 22:
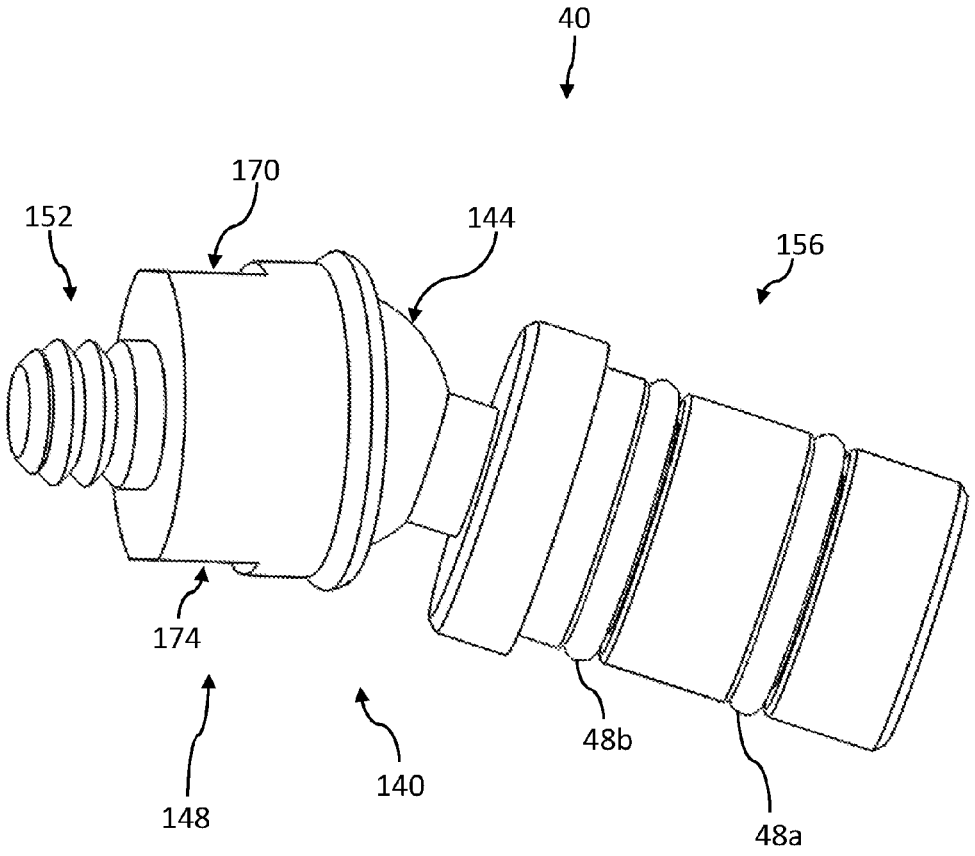
FIG. 22 illustrates a perspective view of a fitting with a movable joint, according to some embodiments.

FIG. 20 illustrates a side view of the second end 156, which is configured to couple with the socket end 148 to form a fitting 40 (shown in FIG. 22). FIG. 21 is a perspective view of the second end 156. Referring now to FIGS. 20 and 21, the second end 156 can include at least one groove 194*a*, 194*b*. The grooves can be separated by cylindrical portions 198. Any of the seals illustrated in FIG. 13, any suitable compliant member, or any seal can be placed at least partially in the grooves 194*a*, 194*b*. The second end 156 can include a shoulder 190, which can separate the grooves 194*a*, 194*b* from the ball end 144. The shoulder 190 can be a cylindrical shoulder.

Several embodiments include methods for using a fitting to couple a rod to a post. The fittings, rods, and/or posts can be made from metal and configured to form at least a portion of a railing system. Embodiments can include obtaining a fitting comprising a first threaded end and a second end coupled to the first threaded end, wherein the second end comprises a first groove and a first seal, wherein at least a portion of the first seal is located in the first groove. Embodiments can include obtaining a rod comprising a hollow inner channel, wherein the second end of the fitting is configured to slide into the hollow inner channel of the rod. Some embodiments include obtaining a post comprising at least one threaded hole. Some posts include at least three holes, at least five holes, or at least ten holes, wherein each hole can be configured to attach to a rod via a fitting. Thus, one post can couple to one rod, at least three rods, at least five rods, at least ten rods, or any suitable number of rods via at least one fitting per rod.

Some embodiments include screwing the first threaded end of the fitting into the threaded hole of the post and/or sliding the rod over the second end of the fitting such that the first seal is located inside of the hollow inner channel of the rod. In several embodiments, the rod comprises an inner diameter and the first seal comprises an outer diameter that is larger than the inner diameter of the rod. Some embodiments include compressing the outer diameter of the first seal radially inward by sliding the rod over the first seal. Thus, the first seal can be radially compressed by the rod.

Several methods include orienting at least one post vertically and orienting at least one rod horizontally. In some cases, rods are oriented at an angle relative to a horizontal plane (e.g., to accommodate stairs or angled surfaces).

Figure 23:
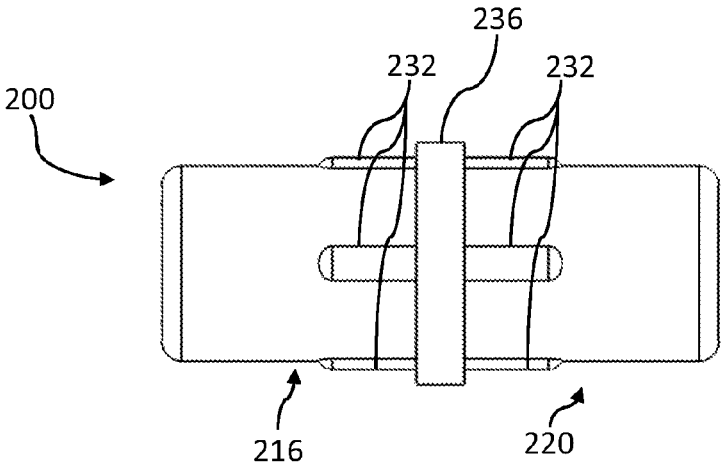
FIG. 23 illustrates a side view of a splice fitting configured to couple a first rod to a second rod, according to some embodiments.
Figure 24:
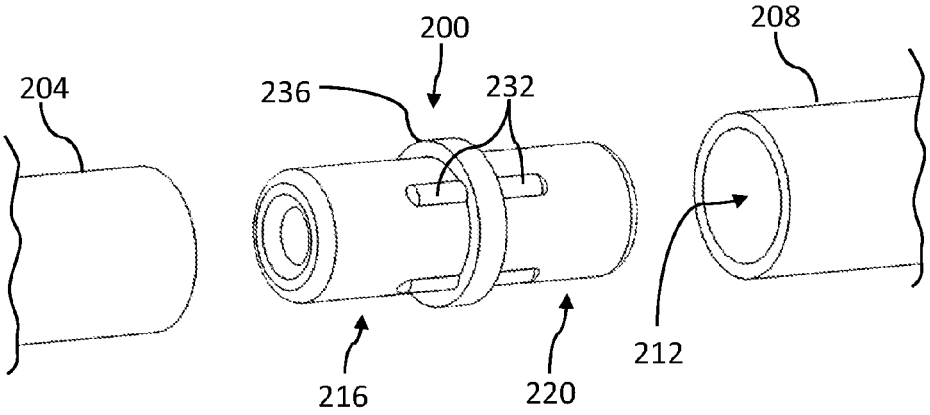
FIG. 24 illustrates a perspective view of a splice fitting before the splice fitting is inserted into rods to couple the rods together, according to some embodiments.
Figure 25:
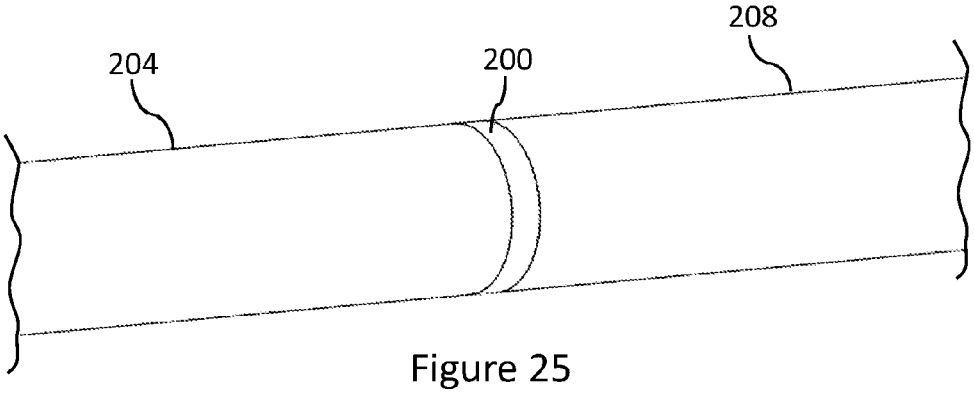
FIG. 25 illustrates a perspective view of a splice fitting after the splice fitting is inserted into the rods, according to some embodiments.

FIG. 23 illustrates a side view of a splice fitting 200 configured to couple a first rod 204 to a second rod 208 (as shown in FIG. 25). FIG. 24 illustrates a perspective view of the splice fitting 200 before the splice fitting 200 is inserted into the rods 204, 208 to couple the rods 204, 208 together. Not all of the radial protrusions 232 are labeled in FIG. 24. FIG. 25 illustrates a perspective view of the splice fitting 200 after the splice fitting 200 is inserted into the rods 204, 208.

Referring now to FIGS. 23-25, each rod 204, 208 can include a hollow end portion 212. The splice fitting 200 can include a first cylindrical end 216 and a second cylindrical end 220. Each cylindrical end 216, 220 can be configured to slide into a hollow end portion 212 of a rod (e.g., 204, 208).

The outer diameter of each cylindrical end 216, 220 can be smaller than an inner diameter of the hollow end portion 212. The splice fitting 200 can include radial protrusions 232 that protrude farther radially outward from the central axis of the splice fitting 200 than the inner diameter of the hollow end portion 212.

A shoulder 236 can have a larger diameter than the inner diameter of the hollow end portion 212. The shoulder 236 can also extend farther radially outward than the radial protrusions 232. The shoulder 236 can be cylindrical and/or can be located in the center of the splice fitting 200.

Fittings, rods, and posts can be made from metal, rubber, and/or plastic. In some embodiments, fittings, rods, and posts are made from stainless steel (e.g., grade 304, grade 316) or aluminum (e.g., 6061 aluminum alloy, 7075 aluminum alloy). Fittings can be machined. For example, a computer numerical control ("CNC") multi-axis mill can be used to machine the components. In several embodiments, fittings are molded from plastic or cast in metal. Rods and posts can be extruded metal and/or plastic. Extruded rods and posts can be cut to a desired length. In some cases, rods and posts can be made from wood. Some compliant members, such as seals, can be molded from rubber.

Figure 26:
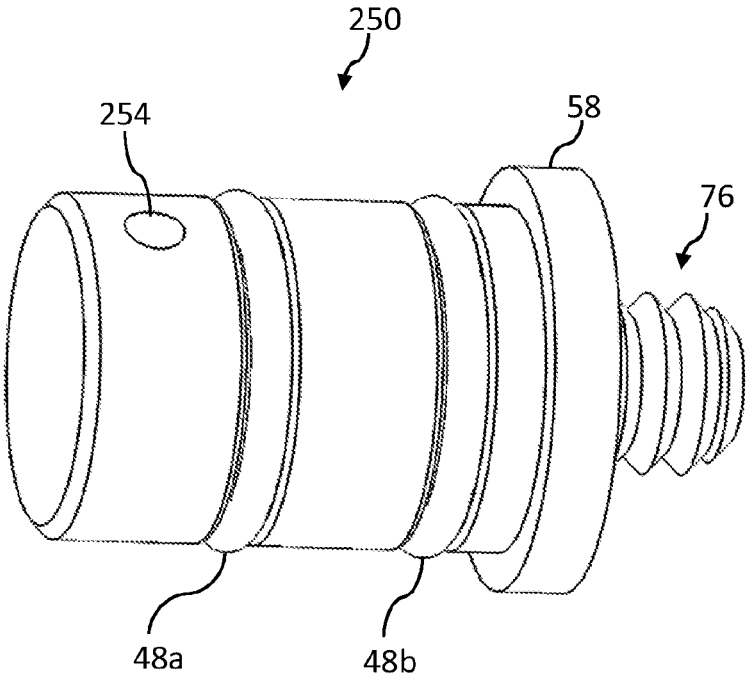
FIG. 26 illustrates a perspective view of a fitting, according to some embodiments.

FIG. 26 illustrates a perspective view of a fitting 250 that is similar to the fitting 30 shown in FIG. 4 and FIG. 10. A rod or tube can slide over the fitting 250 to couple the rod or tube to a post. Referring now to FIGS. 10 and 26, the fitting 250 includes a hole 254, which can be configured to enable a user to grasp the fitting 250 with a tool to thread the fitting 250 into a threaded hole of a post or rail. In some embodiments, the hole 254 is used to enable a person to screw the fitting 250 into a post such that flat surfaces 100, 104 may not be necessary and/or present. A user can insert a tool into the hole 254 and can rotate the tool around the central axis of the threads 76 to couple the fitting 250 to a post. In several embodiments, the hole 254 can have a diameter of approximately 0.08 inches; at least 0.02 inches and/or less than 0.4 inches; or at least 0.05 inches and/or less than 0.15 inches. In several embodiments, the hole 254 can have a depth of approximately 0.15 inches; at least 0.05 inches and/or less than 1.2 inches; or at least 0.1 inches and/or less than 0.25 inches.

Figure 27:
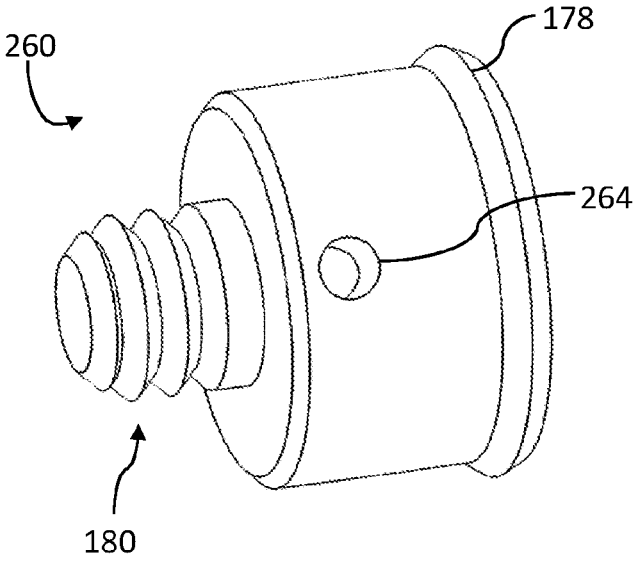
FIG. 27 illustrates a perspective view of a socket end, according to some embodiments.

FIG. 27 illustrates a perspective view of a socket end 260 that is similar to the socket end 148 shown in FIG. 18. The socket end 260 is configured to couple with a ball end (e.g., 144 in FIG. 20, 280 in FIG. 28). Referring now to FIGS. 18 and 27, the socket end 260 includes a hole 264, which can be configured to enable a user to grasp the socket end 260 with a tool to thread the socket end 260 into a threaded hole of a post or rail. In several embodiments, the hole 264 can have a diameter of approximately 0.08 inches; at least 0.02 inches and/or less than 0.4 inches; or at least 0.05 inches and/or less than 0.15 inches. In several embodiments, the hole 264 can have a depth of approximately 0.15 inches; at least 0.05 inches and/or less than 1.2 inches; or at least 0.1 inches and/or less than 0.25 inches.

Figure 28:
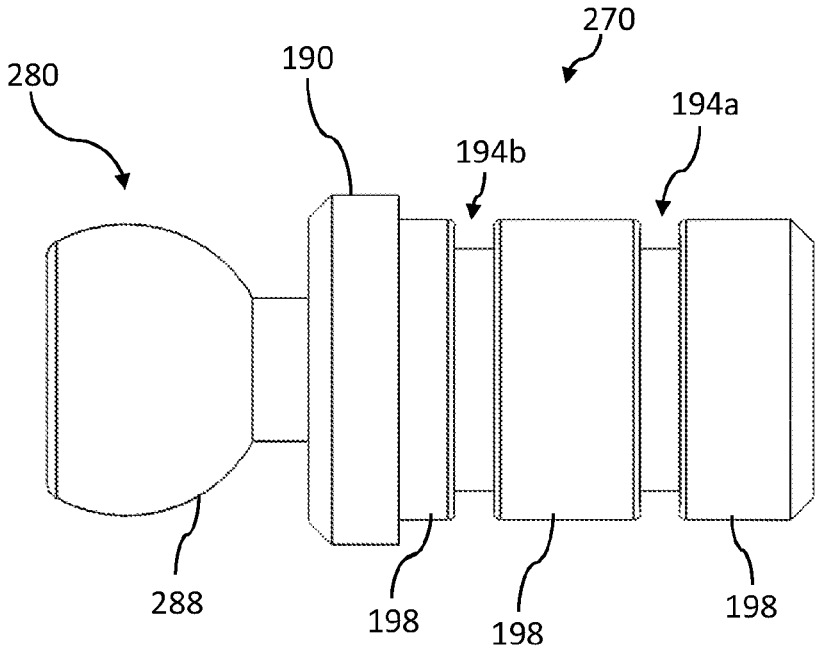
FIG. 28 illustrates a side view of a second end, according to some embodiments.
Figure 29:
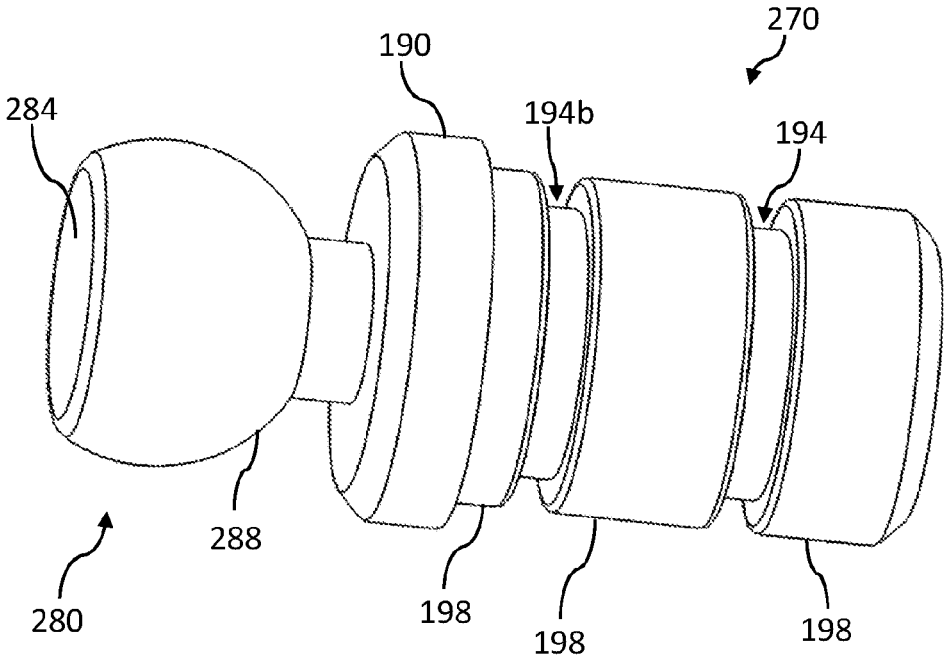
FIG. 29 illustrates a perspective view of a second end, according to some embodiments.

FIG. 28 illustrates a side view of a second end 270 that is similar to the second end 156 illustrated in FIG. 20. FIG. 29 illustrates a perspective view of the second end 270. The ball end 280 can include a partial sphere, a hemisphere 288, and/or a spherical shape with a flat portion 284. The flat portion 284 can be located on one end of the second end 270. As used herein, a ball end does not need to include a complete sphere. A partial sphere can be a ball end.

Figure 30:
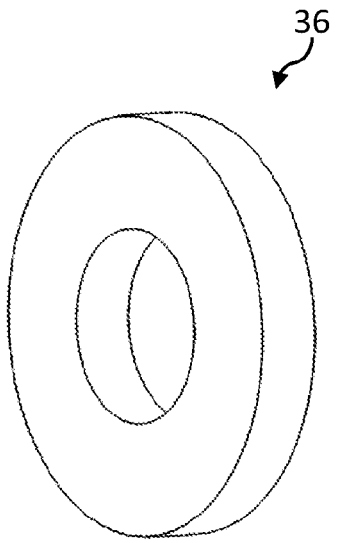
FIG. 30 illustrates a perspective view of a washer, according to some embodiments.

FIG. 30 illustrates a perspective view of a washer 36, which can be a plastic washer or a metal washer. FIG. 3 illustrates the washer 36 just before the washer 36 is placed around the threaded portion of the fitting 30 and then compressed between the fitting 30 and the post 14. Some embodiments do not use a washer.

Figure 31:
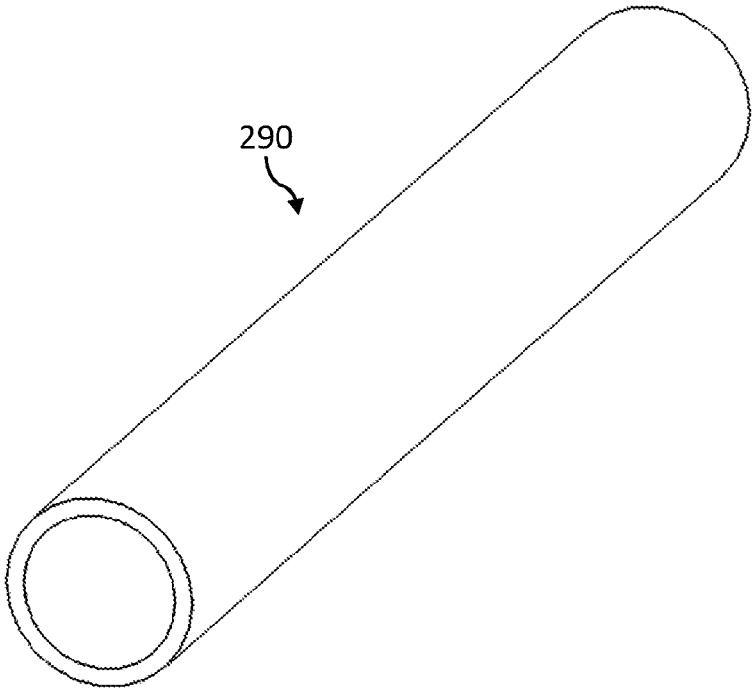
FIG. 31 illustrates a perspective view of a tube, according to some embodiments.
Figure 32:
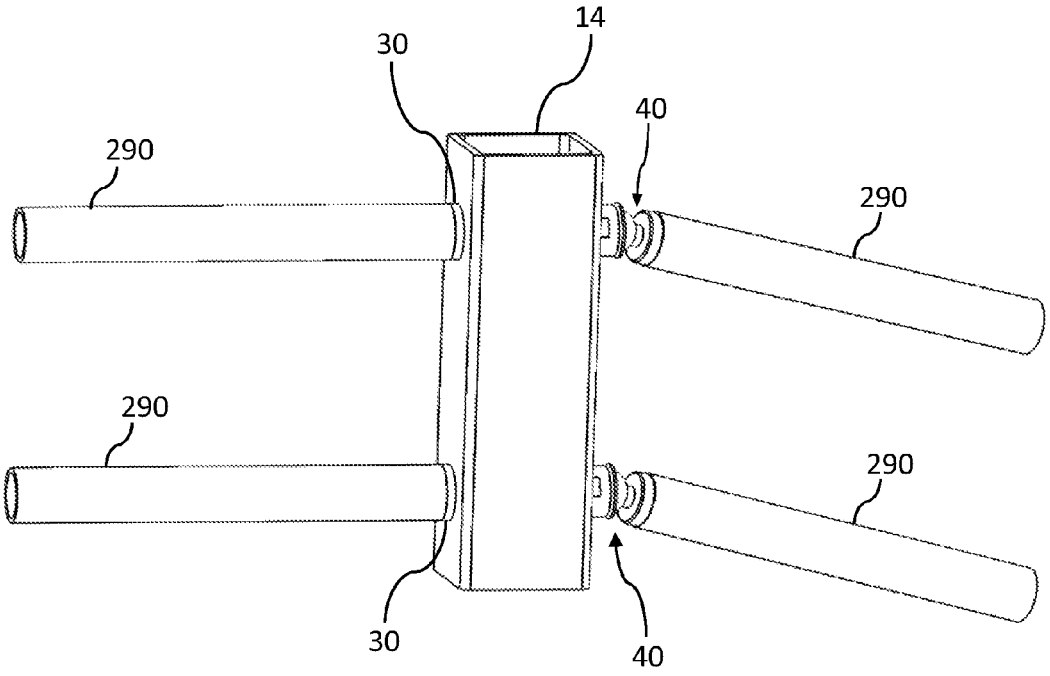
FIG. 32 illustrates a perspective view of tubes coupled to a post via fittings, according to some embodiments.

FIG. 31 illustrates a perspective view of a tube 290. As used herein, tubes are types of rods. Tubes 290 can be rigid or flexible. Tubes 290 can be straight or curved. Tubes 290 can be extruded from metal, such as stainless steel or aluminum. Extruded tubes can be cut to a desired length. FIG. 32 illustrates a perspective view of tubes 290 coupled to a post 14 via fittings 30, 40.

The drawings are not necessarily to scale. The scale of some items in various drawings was altered in the interest of clarity.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The various features and processes described above may be used independently of one another, or may be combined in various ways. All possible combinations and subcombinations are intended to fall within the scope of this disclosure. In addition, certain method, event, state, or process blocks may be omitted in some implementations. The methods and processes described herein are also not limited to any particular sequence, and the blocks or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth.

The term "and/or" means that "and" applies to some embodiments and "or" applies to some embodiments. The term "and/or" is used as described here: A, B, and/or C means that some embodiments can include A and B, some embodiments can include A and C, some embodiments can include B and C, some embodiments can include A, some embodiments can include B, some embodiments can include C, and some embodiments include A, B, and C. The term "and/or" is used to avoid unnecessary redundancy.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

While certain example embodiments have been described herein, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The following is claimed:

1. A railing system comprising:

a rail fitting comprising a second unthreaded end coupled to a first threaded end by a multiaxial joint, wherein the second unthreaded end comprises a first groove, and at least a portion of a first o-ring is located in the first groove;

a rail rod comprising a hollow inner channel, wherein the second unthreaded end of the rail fitting is located in the hollow inner channel of the rail rod; and a rail post comprising a threaded hole, wherein the first threaded end of the rail fitting is threadably coupled with the threaded hole of the rail post, wherein the first threaded end is oriented perpendicularly relative to the rail post, and the first o-ring is compressed radially inward by the rail rod.

2. The railing system of claim 1, wherein the multiaxial joint is configured to enable the first threaded end to move relative to the second unthreaded end, the second unthreaded end comprises a second groove and a second o-ring located at least partially in the second groove, and the second o-ring is configured to form an interference fit between the rail fitting and the rail rod rather than form a watertight seal.

3. The railing system of claim 2, wherein the multiaxial joint comprises a ball end rotatably coupled to a socket end.

4. The railing system of claim 1, wherein the first o-ring comprises an outer diameter and the second unthreaded end comprises a central axis, and the second unthreaded end is located in the rail rod such that the rail rod compresses the outer diameter of the first o-ring towards the central axis of the second unthreaded end.

5. The railing system of claim 4, wherein the first o-ring is a first radial seal.

6. The railing system of claim 1, wherein the second unthreaded end comprises a second groove, the first groove comprises a first diameter and the second groove comprises a second diameter, and the first diameter and the second diameter are isodiametric.

7. The railing system of claim 6, further comprising a cylindrical portion that attaches the first groove to the second groove, wherein the cylindrical portion is unthreaded.

8. The railing system of claim 1, wherein the second unthreaded end comprises a second groove, a first cylindrical portion having a first outer diameter, a second cylindrical portion having a second outer diameter, and a third cylindrical portion having a third outer diameter, wherein the first cylindrical portion is located distally relative to the first groove and the second groove, wherein the second cylindrical portion is located between the first groove and the second groove, and wherein the third cylindrical portion is located proximally relative to the first groove and the second groove.

9. The railing system of claim 8, wherein the first cylindrical portion, the second cylindrical portion, and the third cylindrical portion are isodiametric.

10. The railing system of claim 1, wherein the rail fitting comprises a central axis of the first threaded end, a first flat surface oriented parallel to the central axis, and a second flat surface oriented parallel to the central axis.

11. The railing system of claim 10, wherein the first flat surface and the second flat surface are located on opposite sides of the central axis.

12. The railing system of claim 1, further comprising a shoulder that couples the first threaded end to the second unthreaded end, wherein the shoulder extends farther radially outward than any other portion of the rail fitting, and the shoulder is located proximally relative to a proximal end of the rail rod such that the rail rod slides over a portion of the rail fitting up to the shoulder to limit how far the rail fitting slides into the hollow inner channel of the rail rod.

13. The railing system of claim 1, wherein the rail rod comprises a proximal end, and the rail rod is coupled to the second unthreaded end of the rail fitting such that the first o-ring is located distally relative to the proximal end of the rail rod while the second unthreaded end is oriented at an angle of stairway rise in response to moving the multiaxial joint.

14. A railing system comprising:

a rail fitting comprising a first threaded end and a second unthreaded end coupled to the first threaded end by a movable joint having a ball end rotatably coupled to a socket end, wherein the second unthreaded end comprises a first groove and a first seal located at least partially in the first groove;

a rail rod comprising a hollow inner channel, wherein the second unthreaded end of the rail fitting is located in the hollow inner channel of the rail rod; and a rail post comprising a threaded hole, wherein the first threaded end of the rail fitting is threadably coupled with the threaded hole of the rail post, wherein the first threaded end is oriented perpendicularly relative to the rail post, and the first seal is compressed radially inward by the rail rod.

15. The railing system of claim 14, wherein the rail rod comprises a proximal end and the rail rod is coupled to the second unthreaded end of the rail fitting such that the first seal is located distally relative to the proximal end of the rail rod while the second unthreaded end is oriented at an angle of stairway rise in response to moving the ball end within the socket end.

16. The railing system of claim 14, wherein the movable joint is configured to enable the first threaded end to move relative to the second unthreaded end.

17. The railing system of claim 16, wherein the movable joint is a multiaxial joint, wherein the ball end comprises a spherical shape with a flat proximal end.

18. The railing system of claim 14, wherein the first seal comprises an o-ring.

19. The railing system of claim 14, wherein the second unthreaded end comprises a second groove and a second seal located at least partially in the second groove, the second groove is located distally relative to the first groove, and the first and second grooves are isodiametric.

20. The railing system of claim 14, wherein the second unthreaded end comprises a shoulder that limits how far the rail fitting slides into the hollow inner channel of the rail rod.

* * * * *